US009995293B2

(12) United States Patent
Larsson et al.

(10) Patent No.: US 9,995,293 B2
(45) Date of Patent: Jun. 12, 2018

(54) METHOD FOR CONTROLLING A PUMP

(75) Inventors: Martin Larsson, Sundbyberg (SE); Alexander Fullemann, Stockholm (SE)

(73) Assignee: XYLEM IP HOLDINGS LLC, White Plains, NY (US)

( * ) Notice: Subject to any disclaimer, the term of this patent is extended or adjusted under 35 U.S.C. 154(b) by 172 days.

(21) Appl. No.: 14/126,632

(22) PCT Filed: May 31, 2012

(86) PCT No.: PCT/SE2012/050579

§ 371 (c)(1),
(2), (4) Date: Dec. 16, 2013

(87) PCT Pub. No.: WO2012/173551

PCT Pub. Date: Dec. 20, 2012

(65) Prior Publication Data

US 2014/0134005 A1 May 15, 2014

(30) Foreign Application Priority Data

Jun. 16, 2011 (SE) ..... 1150547

(51) Int. Cl.

*F04B 23/04* (2006.01)
*F04D 13/08* (2006.01)
*F04D 15/02* (2006.01)

(52) U.S. Cl.

CPC ..... *F04B 23/04* (2013.01); *F04D 13/08* (2013.01); *F04D 15/029* (2013.01); *F04D 15/0218* (2013.01)

(58) Field of Classification Search

CPC ..... F04B 23/04; F04B 49/04; F04B 49/00; F04B 49/022; F04B 49/02; F04B 41/06;

(Continued)

(56) References Cited

U.S. PATENT DOCUMENTS 4,273,650 A * 6/1981 Solomon ..... B09C 1/002 210/104
5,190,442 A * 3/1993 Jorritsma ..... F04D 15/0083 417/12
5,503,533 A * 4/1996 Potter ..... G05D 9/12 137/565.23
5,591,010 A * 1/1997 Van Zyl ..... G05D 9/12 417/12
5,597,960 A * 1/1997 Beaudoim ..... F04B 49/025 73/223

(Continued)

FOREIGN PATENT DOCUMENTS

DE 19927365 A1 2/2000
EP 1 256 724 A1 11/2002

(Continued)

OTHER PUBLICATIONS

English Translation of EP 1256724 (Berthon, Jaques).*

(Continued)

*Primary Examiner* — Dominick L Plakkoottam
*Assistant Examiner* — Connor Tremarche
(74) *Attorney, Agent, or Firm* — RatnerPrestia

(57) ABSTRACT

A method for automatic mutual alternation between an arbitrary number of pumps by the control of each individual pump, which makes use of a start condition for a state change from an inactive state of the pump into an active state of the pump to be performed, as well as makes use of a stop condition for a state change from the active state into the inactive state to be performed. The method includes a sub method (Find start condition) that includes the step of, after a predetermined stage, arbitrarily changing the start condition of the individual pump within predetermined limits.

11 Claims, 6 Drawing Sheets

(58) Field of Classification Search
CPC .... F04D 13/08; F04D 15/0218; F04D 15/029; F04D 15/0083; F04D 15/0066; F04D 15/0072; F04D 15/209; C02F 2209/03; C02F 2209/42; E03F 5/107; E03F 5/22; E03F 5/106; B09C 1/002; Y10T 137/8342; G01F 23/42
USPC ..... 417/36, 53, 7, 8; 73/303; 210/97, 104, 210/121, 147, 170.08, 744
See application file for complete search history.

(56) References Cited

U.S. PATENT DOCUMENTS

| | | | | |
|---|---|---|---|---|
| 5,742,500 | A * | 4/1998 | Irvin | F04D 15/0066 417/2 |
| 7,195,462 | B2 | 3/2007 | Nybo et al. | |
| 2004/0071554 | A1 * | 4/2004 | Nybo | F04D 15/029 417/36 |
| 2011/0036164 | A1 * | 2/2011 | Burdi | G01F 23/241 73/303 |

FOREIGN PATENT DOCUMENTS

| | | | | |
|---|---|---|---|---|
| EP | 1256724 | A1 * | 11/2002 | F04D 15/0218 |
| JP | 59148902 | | 8/1984 | |
| JP | 61123902 | | 6/1986 | |
| JP | 2005-240623 | | 9/2005 | |
| JP | 2006022668 | | 1/2006 | |
| JP | 2008038677 | | 2/2008 | |
| JP | 2012215176 | | 11/2012 | |

OTHER PUBLICATIONS

Deinition of Aribtrary per Merriam-Webster Online Dictionary Accessed Feb. 17, 2016.*
"Tailored AC Drive Modules for Water and Wastewater Applications", Apr. 26, 2010, ABB.com.*
Singapore Written Opinion, dated Oct. 16, 2014, corresponding to counterpart Singapore Application No. 201309123-6.
New Zealand Office Action, dated Jun. 13, 2014, corresponding to counterpart New Zealand Patent Application No. 618068.
User Manual GSP201 En ITT Water & Wastewater Oct. 15, 2008; p. 61, Chapter 7.2.5 Random Start Level.
Compact Pump V5.0.2-0: Manual ABB AB, Thomas Thunberg, Sep. 23, 2009; p. 17, Chapter 5.7.
International Search Report, dated Dec. 12, 2012, corresponding to International Application No. PCT/SE2012/050579, filed May 31, 2012.
European Search Report, dated Jan. 28, 2015, corresponding to counterpart European Patent Application No. 12800249.0.
Japanese Office translation dated Apr. 2, 2015 for Japanese Application No. 2014-515783.

* cited by examiner

METHOD FOR CONTROLLING A PUMP

CROSS-REFERENCE TO RELATED APPLICATIONS

This application is a U.S. National Phase Patent Application of PCT Application No. PCT/SE2012/050579, filed May 31, 2012, which claims priority to Swedish Patent Application No. SE1150547-6, filed Jun. 16, 2011, each of which is incorporated by reference herein in its entirety.

TECHNICAL FIELD OF THE INVENTION

The present invention relates generally to a method for controlling a pump. In particular, the present invention relates to a method for automatic mutual alternation between an arbitrary number of pumps by the control of an individual pump, which makes use of a start condition for a state change from an inactive state of the pump into an active state of the pump to be performed, as well as makes use of a stop condition for a state change from said active state into said inactive state to be performed.

BACKGROUND OF THE INVENTION AND PRIOR ART

Traditional fundamental control of a pump station comprising one or more pumps is based on a pump being activated when a start condition is satisfied and is switched off when a stop condition is satisfied. Usually, there is a level instrument arrangement that detects when a pump start liquid level in the sump of the pump station is reached as well as when a pump stop liquid level is reached. According to law and custom, pump stations are almost always equipped with at least two pumps arranged in parallel, where a secondary pump just is a security in case the primary pump breaks or if the inflow to the pump station for the moment is unusually high.

Some manufacturers/users only use the primary pump in normal pumping, but this gives a large wear of the primary pump at the same time as the disposal of faultless function of the secondary pump is uncertain when the same is indeed needed. On the contrary, it is more common to alternate between the primary pump and the secondary pump when emptying of the sump is required.

A simple way of alternation, in view of control, includes that the pumps are active every second time, another way of alternation is to let them be active equally long as measured over a certain time, a third way to alternate the activation of the pumps is to let the pumps be active, for instance, every second day. However, all of said ways of alternation require that the control unit of the pump station, or the respective control unit of the pumps, has knowledge about the number of pumps that are arranged in the pump station and/or that communication takes place between the pumps.

One way to try to avoid communication between the pumps is shown in U.S. Pat. No. 7,195,462, wherein each one of several pumps of one and the same pump station has at least two predefined pump start liquid levels, and wherein the pump that was active most recently assumes the higher pump start liquid level and the other pumps keep the lower pump start liquid level, with the purpose of one of the most recently inactive pumps instead of the most recently active pump being to be activated the next time the liquid level in the sump rises sufficiently high. However, this publication shows that each pump has to be aware of how many other pumps being arranged in the sump.

Common to the previously known solutions is that, at least as regards waste water applications, a considerable tidal mark of grease and dirt will be built up at the fixed pump start liquid level, which is not desirable.

BRIEF DESCRIPTION OF THE OBJECTS OF THE INVENTION

The present invention aims at obviating the above-mentioned disadvantages and failings of previously known methods and at providing an improved method for controlling a pump. A primary object of the invention is to provide an improved method of the initially defined type, which results in that alternation of the active pump will take place without the need of neither direct nor indirect communication between the pumps.

Another object of the present invention is to provide a method that results in that the individual pump does not need to know if or how many other pumps that are installed in the sump.

Another object of the present invention is to provide a method that results in that building up of a tidal mark of grease and dirt on the inside of the sump is prevented.

BRIEF DESCRIPTION OF THE FEATURES OF THE INVENTION

According to the invention, at least the primary object is achieved by the initially defined method, which is characterized in that the same comprises a sub method (Find start condition) that comprises the step of, after a predetermined stage, arbitrarily changing the start condition of the individual pump within predetermined limits.

Accordingly, the present invention is based on the understanding that, by, for several independent pumps, randomly/arbitrarily changing the respective start condition of the pumps, an alternation of the activation of the pumps will take place, since they over time randomly will obtain start conditions corresponding to the lowest pump start liquid level in an alternating way.

Preferred embodiments of the present invention are furthermore defined in the depending claims.

In a preferred embodiment, the step of arbitrarily changing the start condition of the pump comprises the step of determining a pump start liquid level $h_{start}$, which preferably is changed within an interval, which is limited by and which comprises a lower pump start liquid level $h_{start,min}$ and an upper pump start liquid level $h_{start,max}$. This embodiment is preferred in those pump stations that comprise so-called dynamic level instruments that dynamically can determine the liquid level in the sump.

In an alternative preferred embodiment, the step of arbitrarily changing the start condition of the pump comprises the step of determining a start time delay $t_{delay}$ of the pump, which start time delay preferably is changed within an interval, which is limited by and which comprises a lower limit that is equal to 0 and an upper limit $t_{delay,max}$. This embodiment is preferred in those pump stations that comprise so-called static level instruments that only can determine when the liquid level in the sump is on a predetermined level.

Additional advantages and features of the invention are seen in the other dependent claims as well as in the following, detailed description of preferred embodiments.

BRIEF DESCRIPTION OF THE DRAWINGS

A more complete understanding of the above-mentioned and other features and advantages of the present invention will be clear from the following, detailed description of preferred embodiments, reference being made to the accompanying drawings, wherein.

DETAILED DESCRIPTION OF PREFERRED EMBODIMENTS

Figure 1:
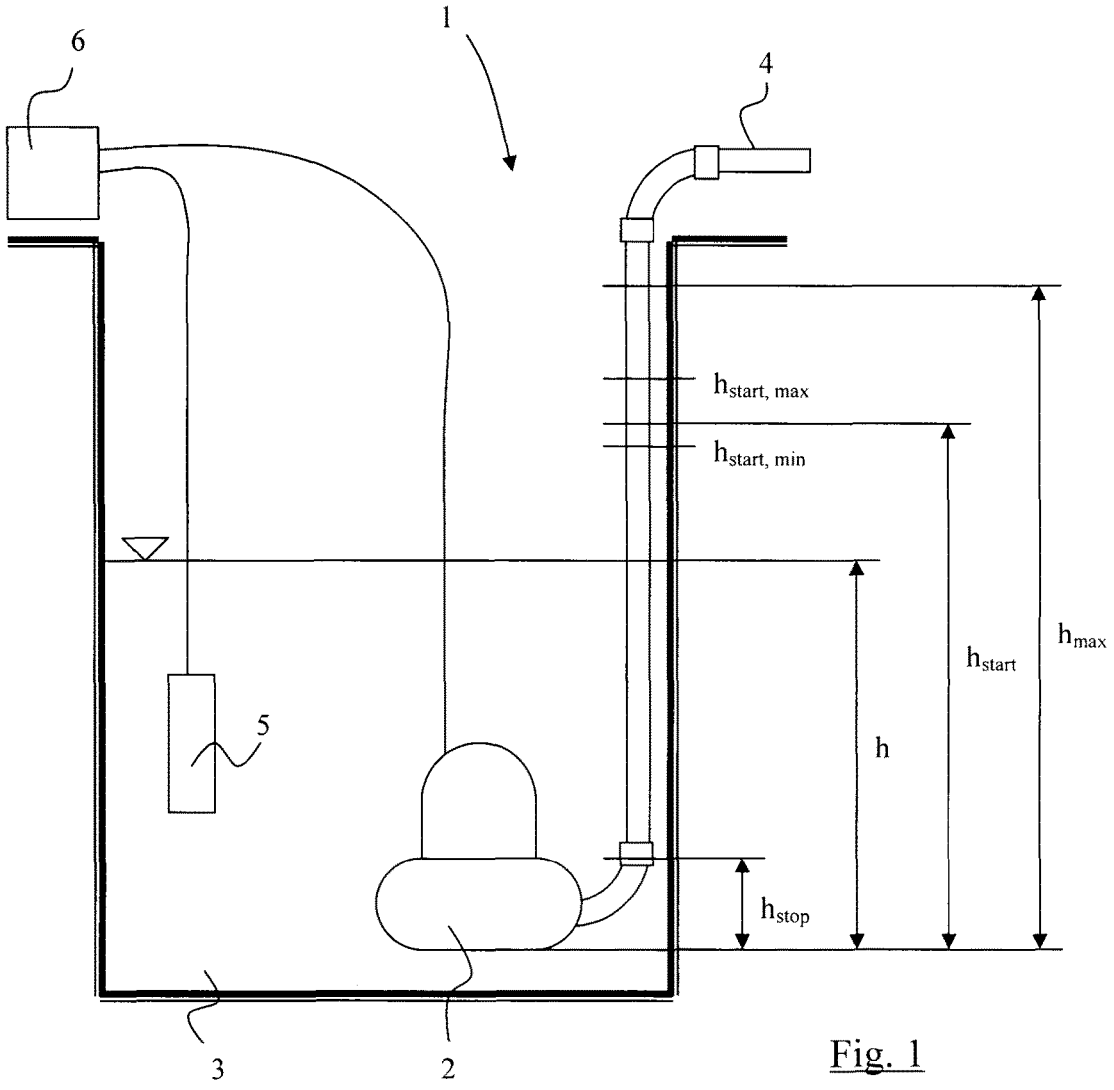
FIG. 1 is a schematic illustration of a pump station.

In FIG. 1, a pump station is shown, generally designated 1, comprising at least one pump 2, which is arranged to pump liquid from a sump 3 included in the pump station 1 to an outlet pipe 4 and further away from the pump station 1. Further, the pump station 1 comprises at least one level instrument 5 arranged to determine the pump station liquid level h; it should be pointed out that the level instrument 5 may be an individual device that is operatively connected to an external control unit 6, be operatively connected to said at least one pump 2, be built-in in said at least one pump 2, etc. Said at least one pump 2 is preferably operatively connected to the external control unit 6 with the purpose of, for instance, allowing regulation of the pump speed, alternatively the pump 2 comprises a built-in control unit (not shown). It should be pointed out that the present invention is aimed at a method, generally designated 7, for controlling a pump 2, the invention is accordingly not limited to the pump 2 having to be arranged in or at a pump station 1, but may, for instance, be a drainage pump having associated level instruments, etc. However, the present invention will be described in connection with the pump station 1 described above if nothing else is stated.

Said pump 2 makes use of a start condition for a state change from an inactive state of the pump into an active state of the pump to be performed, as well as makes use of a stop condition for a state change from said active state into said inactive state to be performed. With the expression "makes use of", as used in the claims as well as in the detailed description, it is intended that the start conditions and the stop conditions, for instance, reside in said external control unit 6 and that the same produces state change of the pump 2, alternatively, the start conditions and the stop conditions may, for instance, reside in a control unit in the pump 2, or the like.

The pump station 1 has a pump station liquid level, which is designated h and which in the present patent application is the distance between the liquid level in the sump 3 and the inlet of the pump 2 (see FIG. 1), the pump station liquid level h is also coupled to the real lifting height of the pump 2, which increases with falling pump station liquid level h. When the sump 3 is refilled with liquid, the pump station liquid level h rises, and when the pump 2 is active and pumps out liquid, the pump station liquid level h falls. It should be pointed out that the sump 3 can be refilled with liquid at the same time as the pump 2 is active and pumps out liquid.

The stop condition for a pump 2 is usually a pump stop liquid level $h_{stop}$ that corresponds to a liquid level in the sump 3 where the pump 2 is snooring, i.e., pumps a mixture of air and liquid, or is a predetermined lowest pump stop liquid level $h_{stop}$ that corresponds to a liquid level in the sump that is sufficiently high to guarantee that snooring does not occur. Usually, the stop conditions of the pump 2 are unchanged over time.

According to the present invention, the start condition for the pump 2 is arbitrarily changed within predetermined limits. Preferably, the start condition of the pump 2 consists of a pump start liquid level $h_{start}$ that corresponds to a liquid level in the sump 3 that is positioned with a margin at a distance from the liquid level in the sump 3 when the pump station 1 is flooded.

In FIGS. 2-5, there are shown preferred embodiments of the method 7 according to the invention for controlling a pump 2. It should be pointed out that the method 7 according to the invention may be expanded using one or more sub methods, and/or be run in parallel/sequentially with other control methods. The method 7 according to the invention comprises a sub method, designated "Find start condition", which serves the purpose of arbitrarily changing the start condition of the pump 2 within predetermined limits. The object of said sub method is to periodically change the start condition of the specific pump 2 in such a way that, in case there are several pumps arranged in one and the same sump 3, i.e., are connected to one and the same liquid volume, an alternation of the activation of the pumps will take place automatically without any pump needing to know whether additional pumps are arranged in the same sump 3.

Figure 2:
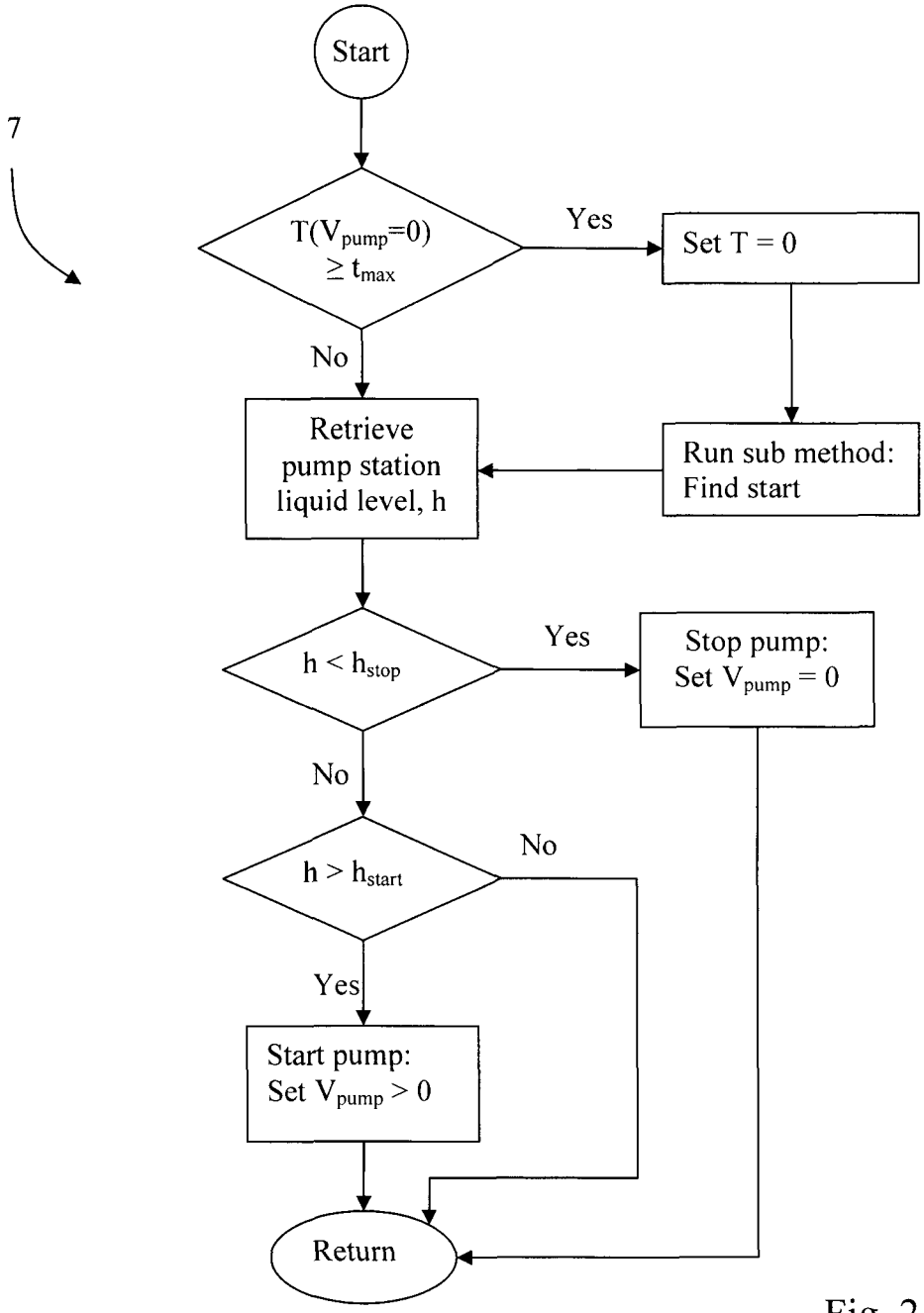
FIG. 2 is a flow chart showing a first embodiment of the method according to the invention.
Figure 3:
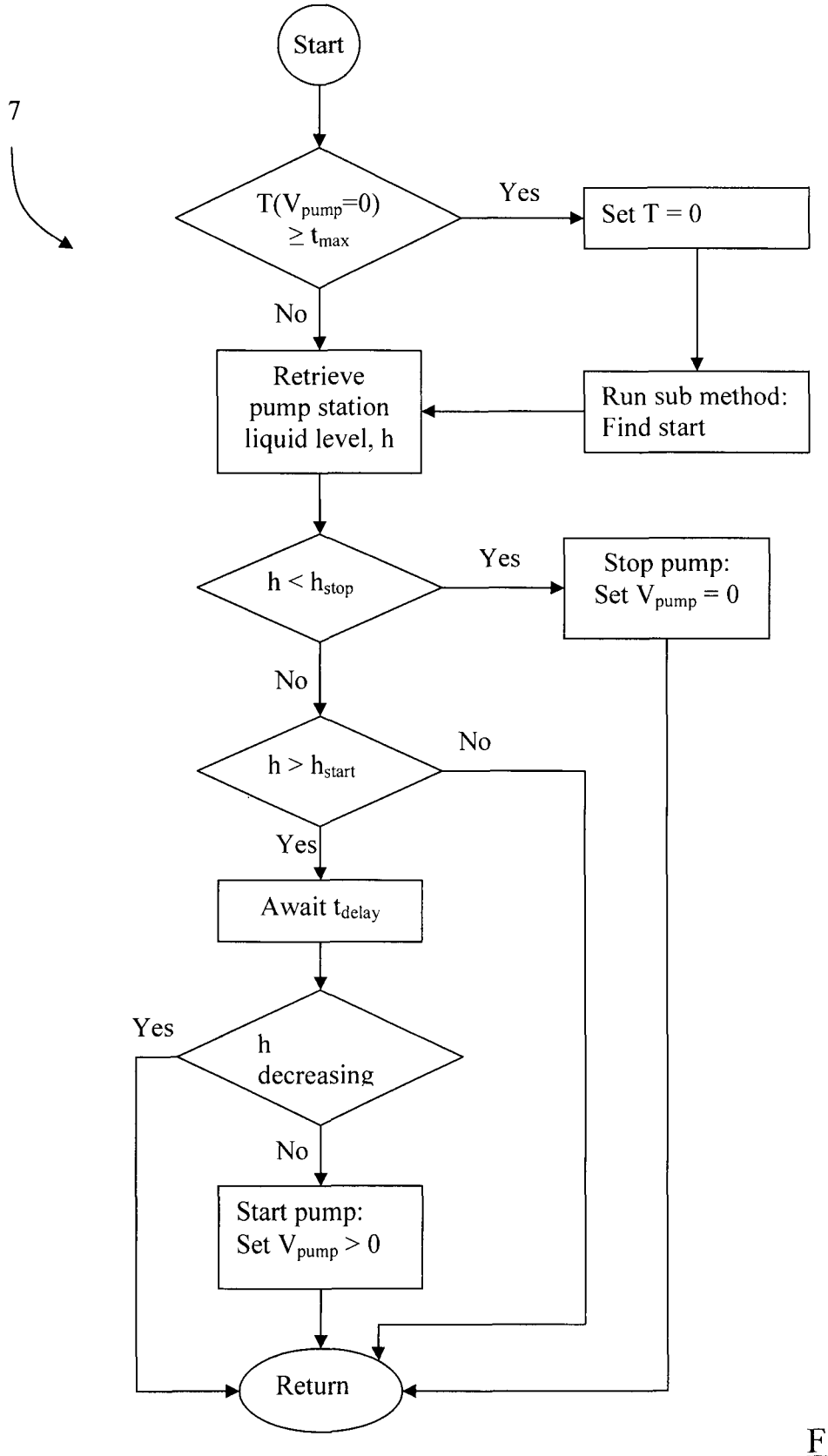
FIG. 3 is a flow chart showing a second embodiment of the method according to the invention.

Reference is now made to FIGS. 2 and 3. The method 7 starts and then a check is made if a certain stage has elapsed. Said stage consists preferably of an operating period, which preferably has the length 24 h or a multiple of 24 h, alternatively said stage may consist of a number of pump cycles, i.e., how many times the liquid level in the sump 3 has fallen or how many times the specific pump has been active, alternatively said stage may consist of a maximum time $t_{max}$ that the specific pump has been inactive, or another suitable measurable course of events. In FIG. 2, this check step is illustrated by means of whether the condition $T(V_{pump}=0) \geq t_{max}$ is satisfied, wherein $T(V_{pump}=0)$ is elapsed time during which the individual pump speed $V_{pump}$ of the pump 2 has been equal to zero, i.e., how long the pump has been inactive. However, it should be realized that also the other above-mentioned and other similar check step alternatives are included in the check step shown in FIGS. 2 and 3 and handles whether a stage has elapsed.

In the case of checking of completed operating period, the measurement of elapsed time T of the operating period in progress is set to zero in connection with an operating period being completed and another one being initiated. It should be pointed out that T may also be actual, or absolute, time, and then the relationship between actual time and a multiple of the operating period is checked instead, i.e., for instance every time the actual time strikes 00:00, a new operating period starts. Also in the case when checking of how long the specific pump has been inactive, the measurement of elapsed time T is set to zero, and then the measurement of elapsed time T starts once again when the individual pump next time is stopped and the pump speed $V_{pump}$ is set equal to zero. In the case when checking of a number of elapsed pump cycles or the like is made, this counter is set to zero correspondingly.

After an affirmative check whether a certain stage has elapsed, and in connection with possible resetting of the appropriate counter/clock, the method 7 proceeds to a sub method designated "Find start condition", which aims at determining the next start condition for the specific pump 2. The sub method "Find start condition" will be described more in detail below after the overall method 7 has been described.

After the sub method "Find start condition", alternatively after a negative check whether a certain stage has elapsed, the method 7 continues to the next method step, which is "Retrieve pump station liquid level, h".

The pump station liquid level h is determined by means of some form of customary level instrument arrangement, which may comprise one or more co-operating level instruments 5, which may be static or dynamic. Static level instruments may also be called discrete, fixed, etc. Static level instruments, such as a conventional tiltable level instrument, checks if a predetermined liquid level has been attained. Dynamic level instruments may also be called continuous, analog, etc. Dynamic level instruments, such as an acoustic level instrument being immersed or sound echo or light reflection level instruments suspended above, can, unlike static level instruments, continuously check the instantaneous liquid level in the sump 3.

When the pump station liquid level h has been retrieved, a check is made if the pump station liquid level h in the sump 3 is lower than the liquid level that corresponds to a pump stop liquid level $h_{stop}$, i.e., whether the condition $h<h_{stop}$ is satisfied. If the condition $h<h_{stop}$ is satisfied, the pump speed $V_{pump}$ is set equal to zero and the possibly active pump 2 is switched off, and the method 7 is terminated and returns to start. If the condition $h<h_{stop}$ is not satisfied, it is then checked if the liquid level in the sump 3 is higher than the liquid level that corresponds to a pump start liquid level $h_{start}$, i.e., whether the condition $h>h_{start}$ is satisfied. If the condition $h>h_{start}$ is satisfied, the pump 2 is activated at a pump speed $V_{pump}$ that is greater than zero, selected pump speed may be optimized in a suitable way. If the condition $h>h_{start}$ is not satisfied, alternatively after the pump 2 has been activated, the method 7 is terminated and returns to start according to the preferred embodiment according to FIG. 2. In the embodiment according to FIG. 2, the start condition of the pump consists of $h_{start}$.

According to the embodiment shown in FIG. 3, the start condition of the pump consists a pump start liquid level $h_{start}$ as well as a time delay $t_{delay}$ that is a delay between when the liquid level in the sump 3 reaches the pump start liquid level $h_{start}$ and a check whether the pump station liquid level h falls/decreases is carried out. Similar to the embodiment according to FIG. 2, the method 7 is terminated and returns to start if the condition $h>h_{start}$ is not satisfied, but in case the condition $h>h_{start}$ is satisfied, the method 7 proceeds instead into a pause method step and awaits the time $t_{delay}$, after that a check is made if the pump station liquid level h in the sump 3 falls/decreases. If the pump station liquid level h falls, it shows that one or more other pumps are active and pump out liquid from the common liquid volume. Accordingly, these other pumps have been activated while the specific pump 2 has awaited the time $t_{delay}$. The method 7 is terminated and returns to start. If the pump station liquid level h does not fall/decrease, the specific pump 2 is activated at a pump speed $V_{pump}$ that is greater than zero, after which the method 7 is terminated and returns to start. It should be pointed out that the steps of checking the conditions $h<h_{stop}$ and $h>h_{start}$, together with the respective associated subsequent method step, can interchange place without the method in other respects, or the present invention, being affected.

Figure 4:
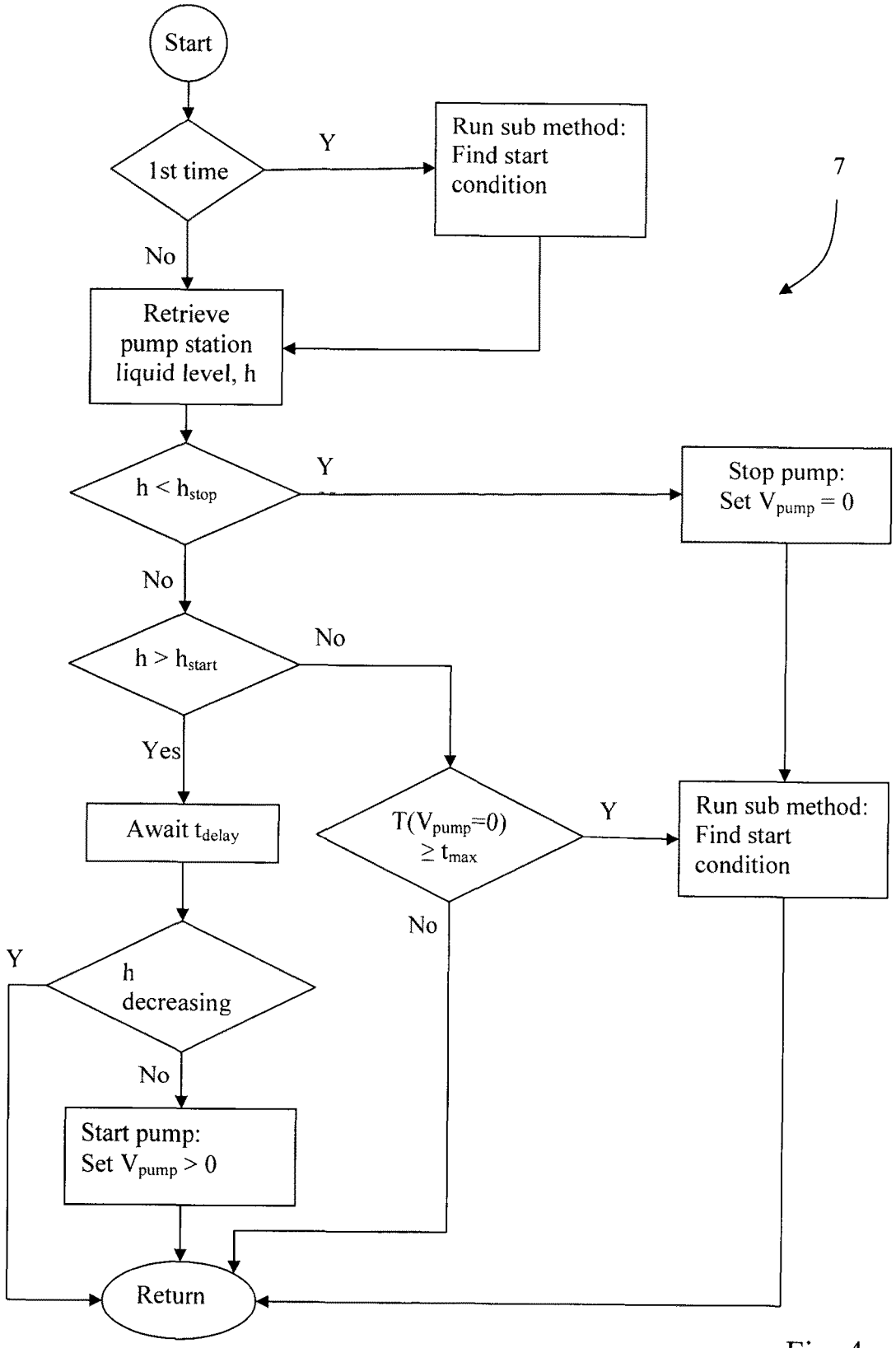
FIG. 4 is a flow chart showing a third embodiment of the method according to the invention.

Reference is now made to FIG. 4 that shows a third embodiment of the present method 7. The method 7 starts and then a check is made if a certain stage has elapsed. In this embodiment, said stage consists of whether it is the first time the method 7 is executed, for instance after the pump 2 was energized or after the method 7 was restarted.

After an affirmative check whether a certain stage has elapsed, the method 7 proceeds to the sub method "Find start condition", which aims at finding next start condition for the individual pump 2. After the sub method "Find start condition", alternatively after a negative check whether a certain stage has elapsed, the method 7 continues to the next method step "Retrieve pump station liquid level, h" as described above in the context of FIGS. 2 and 3.

When the pump station liquid level h has been retrieved, a check is made if the pump station liquid level h in the sump 3 is lower than the pump stop liquid level $h_{stop}$, i.e., whether the condition $h<h_{stop}$ is satisfied. If the condition $h<h_{stop}$ is satisfied, the pump speed $V_{pump}$ is set equal to zero and the possibly active pump 2 is switched off, then the method 7 proceeds to the sub method "Find start condition", whereupon the method 7 is terminated and returns to start. If the condition $h<h_{stop}$ is not satisfied, a check is made if the liquid level in the sump 3 is higher than the pump start liquid level $h_{start}$, i.e., whether the condition $h>h_{start}$ is satisfied.

If the condition $h>h_{start}$ is satisfied, the method 7 proceeds into a pause method step and awaits the time $t_{delay}$, then a check is made if the pump station liquid level h in the sump 3 falls/decreases, after which the method 7 is terminated and returns to start in case the pump station liquid level h in the sump 3 decreases/falls as described above in the context of FIG. 3. If the pump station liquid level h does not fall/decrease, the specific pump 2 is activated at a pump speed $V_{pump}$ that is greater than zero, after which the method 7 is terminated and returns to start.

If the condition $h>h_{start}$ is not satisfied, the check that initially was executed in the embodiments according to FIGS. 2 and 3, i.e., whether a certain stage has elapsed, is made. After an affirmative check, the method 7 proceeds to the sub method "Find start condition", whereupon the method 7 is terminated and returns to start. After a negative check, the method 7 is terminated directly and returns to start.

Figure 5:
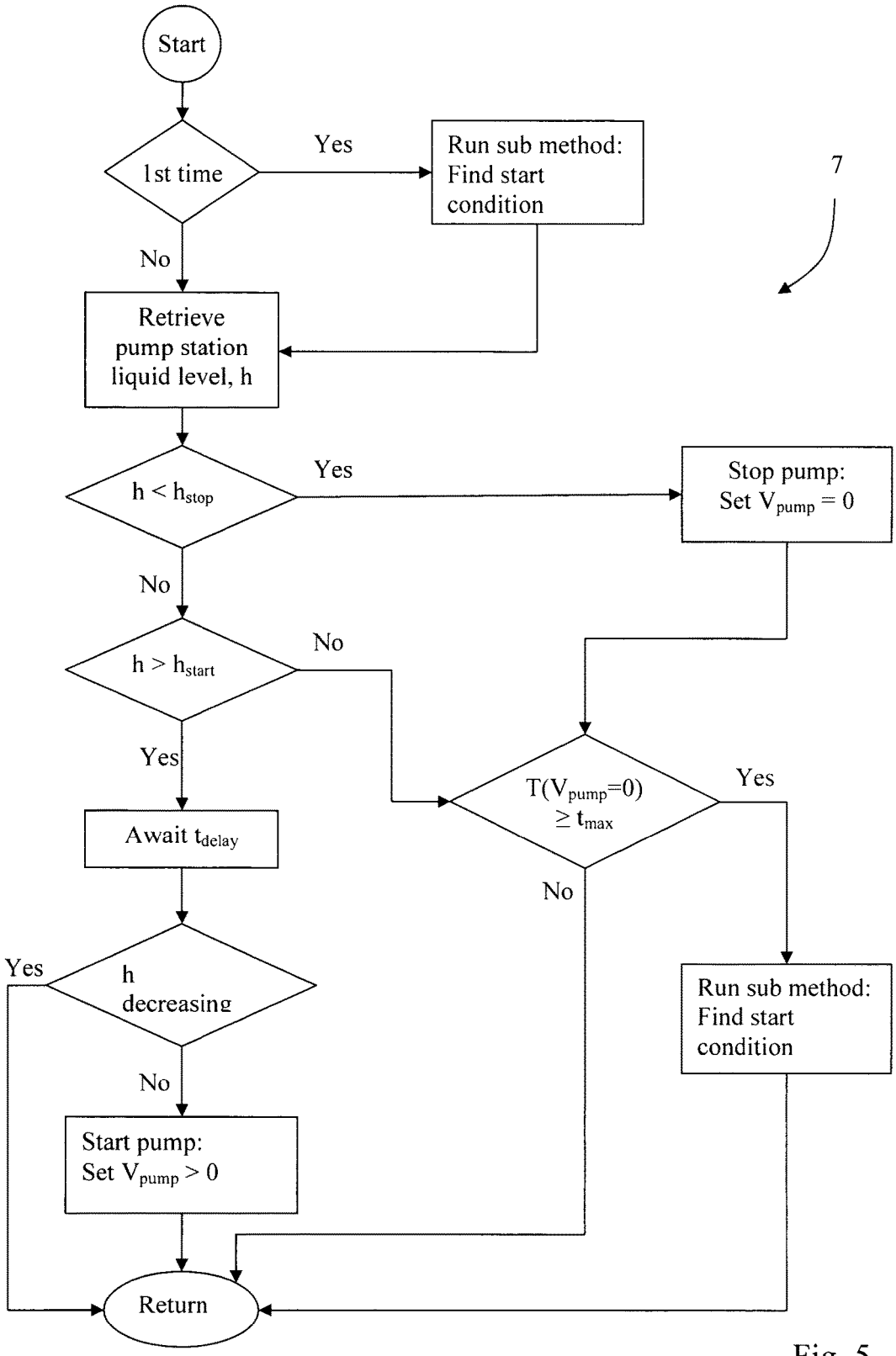
FIG. 5 is a flow chart showing a fourth embodiment of the method according to the invention.

According to a fourth embodiment according to FIG. 5, which is an alternative embodiment of the third embodiment shown in FIG. 4, the method 7 proceeds, after the condition $h<h_{stop}$ has been checked and the pump speed $V_{pump}$ been set equal to zero, to made the initial check in the embodiments according to FIGS. 2 and 3, i.e., whether a certain stage has elapsed, instead of performing the sub method "Find start condition". It should be pointed out that the embodiments according to FIGS. 4 and 5 may, after an affirmative check of the condition $h>h_{start}$, be changed like the embodiment according to FIG. 2, i.e., that the method steps await $t_{delay}$ and check whether the pump station liquid level h decreases are removed.

It should be pointed out that if the individual pump is active but the liquid level in the sump 3 does not fall/decrease but instead increases, other pumps will be activated when their respective pump start liquid levels $h_{start}$ are reached. If this does not help, the pump station 1 may be provided with a maximally allowed pump station liquid level $h_{max}$, on which the speed of one or more pumps is raised with the purpose of preventing the pump station 1 from being flooded.

Figure 6:
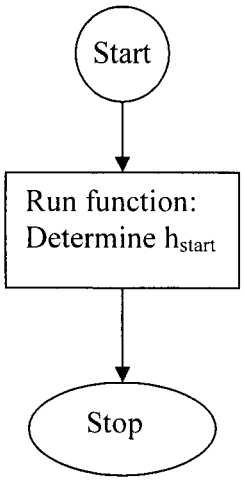
FIG. 6 is a flow chart showing a first embodiment of the sub method "Find start condition"
Figure 7:
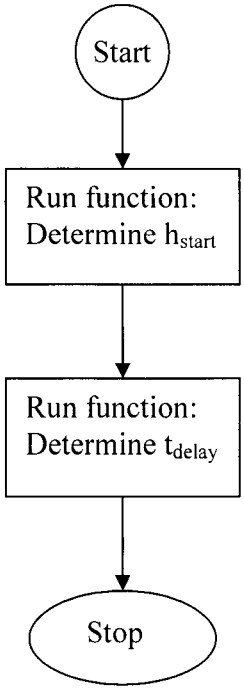
FIG. 7 is a flow chart showing a second embodiment of the sub method "Find start condition".

In FIG. 6, a first embodiment of the sub method "Find start condition" is shown, and in FIG. 7, a second embodiment of the sub method "Find start condition" is shown.

Common to the shown sub methods "Find start condition" is that after start, a first sub method step "Run function: Determine $h_{start}$" is carried out, which means determination of a value of the pump start liquid level $h_{start}$, i.e., on which liquid level in the sump 3 the specific pump 2 should be activated. The value of the pump start liquid level $h_{start}$ is selected arbitrarily within an interval having predetermined limits. The interval is limited by and comprises a lower pump start liquid level $h_{start,min}$ and an upper pump start liquid level $h_{start,max}$. The distance between the lower pump start liquid level $h_{start,min}$ and the upper pump start liquid level $h_{start,max}$ is preferably less than 1 m, more preferably less than 0.5 m. Preferably, the value of the pump start liquid level $h_{start}$ is selected arbitrarily according to a uniform distribution, preferably according to a discrete uniform distribution, within said interval. The distance between the discrete values of pump start liquid level $h_{start}$ is preferably greater than or equal to 1 cm and smaller than or equal to 10 cm, more preferably approximately equal to 5 cm.

According to the first embodiment of the sub method "Find start condition" shown in FIG. 6, the sub method is terminated after that.

According to the second embodiment of the sub method "Find start condition" shown in FIG. 7, a second sub method step "Run function: Determine $t_{delay}$" is carried out, which means determination of a value of the time delay $t_{delay}$ that is a delay of the method 7 after the liquid level in the sump 3 reaches the pump start liquid level $h_{start}$, i.e., in practice it is a delay of the activation of the specific pump 2. The value of the time delay $t_{delay}$ is selected arbitrarily within an interval having predetermined limits. The interval is limited by and comprises a lower limit $t_{delay,min}$ and an upper limit $t_{delay,max}$. Preferably, the lower limit is equal to 0 . The time lag between the lower limit $t_{delay,min}$ and the upper limit $t_{delay,max}$ is preferably less than 10 min, more preferably less than 5 min. Preferably, the value of the time delay $t_{delay}$ is selected arbitrarily according to a uniform distribution, preferably according to a discrete uniform distribution, within said interval. The distance between the discrete values of the time delay $t_{delay}$ is preferably greater than or equal to 10 s and smaller than or equal to 1 min, more preferably approximately equal to 0.5 min.

It should be pointed out that in the second embodiment of the sub method "Find start condition", the upper pump start liquid level $h_{start,max}$ may be equal to the lower pump start liquid level $h_{start,min}$. This relationship is at hand, for instance, in the case when a static level instrument is employed. In an alternative embodiment, the upper limit $t_{delay,max}$ of the time-delay may be equal to the lower limit $t_{delay,min}$ of the same, wherein, in practice, the first embodiment of the sub method "Find start condition" is obtained.

FEASIBLE MODIFICATIONS OF THE INVENTION

The invention is not limited only to the embodiments described above and shown in the drawings, which only have the purpose of illustrating and exemplifying. This patent application is intended to cover all adaptations and variants of the preferred embodiments described herein, and consequently the present invention is defined by the wording of the accompanying claims and the equivalents thereof. Accordingly, the equipment can be modified in all feasible ways within the scope of the accompanying claims.

It should also be pointed out that all information about/regarding terms such as upper, under, etc., should be interpreted/read with the equipment orientated in accordance with the figures, with the drawings orientated in such a way that the reference designations can be read in a proper way. Accordingly, such terms only indicate mutual relationships in the shown embodiments, which relationships may be changed if the equipment according to the invention is provided with another construction/design.

It should be pointed out that even if it is not explicitly mentioned that features from one specific embodiment can be combined with the features of another embodiment, this should be regarded as evident when possible.

The invention claimed is:

1. A method for automatic mutual alternation between or among a plurality of installed pumps by the control of each individual pump, without direct or indirect communication between or among the respective pumps, which makes use of a start condition for a state change from an inactive state of the pump into an active state of the pump to be performed, as well as makes use of a stop condition for a state change from said active state into said inactive state to be performed, wherein the method for the control of each individual pump, comprises a sub method performed by a control unit that comprises the step of, after a predetermined stage, randomly changing the start condition of the individual pump within predetermined limits by randomly determining a pump start liquid level $h_{start}$ for the individual pump, without considering how many other pumps are installed.

2. The method according to claim 1, wherein the pump start liquid level $h_{start}$ is randomly changed within an interval, which is limited by and which comprises a lower pump start liquid level $h_{start,min}$ and an upper pump start liquid level $h_{start,max}$.

3. The method according to claim 2, wherein the distance between the lower pump start liquid level $h_{start,min}$ and the upper pump start liquid level $h_{start,max}$ is smaller than 1 m.

4. The method according to claim 1, wherein the pump start liquid level $h_{start}$ is determined randomly according to a discrete uniform distribution within said predetermined limits.

5. The method according to claim 4, wherein the distance between the discrete values of pump start liquid level $h_{start}$ is greater than or equal to 1 cm and smaller than or equal to 10 cm.

6. The method according to claim 1, wherein the step of randomly changing the start condition of the pump comprises the step of determining a time delay $t_{delay}$ for the activation of the pump.

7. The method according to claim 6, wherein the start time delay $t_{delay}$ is randomly changed within an interval, which is limited by and which comprises a lower limit $t_{delay,min}$ and an upper limit $t_{delay,max}$.

8. The method according to claim 7, wherein the time lag between the lower limit $t_{delay,min}$ and the upper limit $t_{delay,max}$ is less than 10 min.

9. The method according to claim 6, wherein the time delay $t_{delay}$ is determined randomly according to a discrete uniform distribution, within said predetermined limits.

10. The method according to claim 9, wherein the distance between the discrete values of the time delay $t_{delay}$ is greater than or equal to 10 seconds and smaller than or equal to 1 min.

11. The method according to claim 6, further comprising upon the value $h_{start}$ for the individual pump being achieved, instituting the time delay $t_{delay}$, checking whether liquid level falls/decreases over the time delay, and changing the pump from the inactive state into the active state only if liquid level h does not fall/decrease over the time delay.

* * * * *